US006321938B1

(12) United States Patent
Edwards et al.

(10) Patent No.: US 6,321,938 B1
(45) Date of Patent: Nov. 27, 2001

(54) NOZZLE ASSEMBLY FOR A BEVERAGE DISPENSER

(75) Inventors: William A. Edwards, Lavernia; Randeep S. Grewal, San Antonio; Michael J. Angelica, San Antonio; John D. Santy, Jr., San Antonio, all of TX (US)

(73) Assignee: Lancer Partnership, Ltd., San Antonio, TX (US)

( * ) Notice: Subject to any disclaimer, the term of this patent is extended or adjusted under 35 U.S.C. 154(b) by 0 days.

(21) Appl. No.: 09/425,641

(22) Filed: Oct. 22, 1999

(51) Int. Cl.[7] ..... B67B 7/00
(52) U.S. Cl. ..... 222/1
(58) Field of Search ..... 222/1, 129.1, 132, 222/144.5, 214, 459, 325, 145.1, 145.5, 145.6

(56) References Cited

U.S. PATENT DOCUMENTS 4,753,370 * 6/1988 Rudlick ..... 222/129.1
5,082,143 * 1/1992 Schramm, Jr. ..... 222/129.1
5,553,749 * 9/1996 Oyler et al. ..... 222/129.1

* cited by examiner

*Primary Examiner*—Kevin Shaver
*Assistant Examiner*—Steven Willatt
(74) *Attorney, Agent, or Firm*—Christopher L. Makay

(57) ABSTRACT

A beverage dispenser nozzle assembly for increasing availability of drink flavors dispensed therefrom, includes a first, a second, and a third beverage fluid line for carrying a first beverage fluid, a second beverage fluid, and a third beverage fluid therein, respectively. A dispensing nozzle unit linked with the first, the second, and the third beverage fluid lines is provided for receiving and combining the third beverage fluid with the first and/or the second beverage fluids, thereby producing a desired drink for discharge by the nozzle assembly. This single dispensing nozzle unit thus accommodates a large number of beverage fluid lines, thereby enhancing the availability of drink flavors dispensed from the nozzle assembly. Moreover, the nozzle assembly includes a multi-port fitting device and a swivel fitting device for facilitating coupling of a dispensing nozzle unit with a large number of beverage fluid lines.

26 Claims, 7 Drawing Sheets

NOZZLE ASSEMBLY FOR A BEVERAGE DISPENSER

BACKGROUND OF THE INVENTION

1. Field of the Invention

The present invention generally relates to dispensing equipment and, more particularly, but not by way of limitation, to a nozzle assembly for increasing availability of drink flavors dispensed therefrom.

2. Description of the Related Art

Beverage dispensers dispense a beverage flavored syrup mixed with either plain water to form a drink, such as punch, or carbonated water to form a carbonated drink, such as cola. Typically, these beverage fluids are each drawn from a respective beverage fluid source by a pump. Each beverage fluid is carried by a separate beverage fluid line from a beverage fluid source to a dispensing nozzle. Beverage fluids are then combined by the dispensing nozzle to form a desired drink.

Beverage dispensers often feature a variety of drink flavors whereby each flavor requires a different beverage flavored syrup to form a desired drink. Therefore, to increase the variety of drink flavors, a separate beverage fluid line is required for every new flavor added to deliver such beverage flavored syrup to the dispensing nozzle. Unfortunately, due to space constraints, dispensing nozzles can only accommodate a limited number of beverage fluid lines, thus, compromising drink flavor availability.

Accordingly, there is a long felt need for a beverage dispenser nozzle assembly whereby a single dispensing nozzle unit from the nozzle assembly can accommodate a large number of beverage fluid lines to enhance the availability of drink flavors dispensed therefrom.

SUMMARY OF THE INVENTION

In accordance with the present invention, a beverage dispenser nozzle assembly for increasing availability of drink flavors dispensed therefrom, includes a first, a second, and a third beverage fluid line for carrying a first beverage fluid, a second beverage fluid, and a third beverage fluid therein, respectively. A dispensing nozzle unit linked with the first, the second, and the third beverage fluid lines is provided for receiving and combining the third beverage fluid and one or, alternatively, both of the first and the second beverage fluids, thereby producing a desired drink for dispensing by the nozzle assembly.

In particular, the dispensing nozzle unit includes a base portion, an upper portion and a central inlet passageway extending through the dispensing nozzle unit from the upper portion to the base portion. The central inlet passageway includes a first collecting chamber extending through the dispensing nozzle unit and a first directional channel linked with the first collecting chamber for directing the first beverage fluid to the base portion. The central inlet passageway also includes a second collecting chamber extending through the dispensing nozzle unit and a second directional channel linked with the second collecting chamber for directing the second beverage fluid from the second collecting chamber to the base portion. Therefore, in the preferred embodiment, the central inlet passageway receives the first and the second beverage fluids from the first and the second beverage fluid lines and directs these fluids to the base portion for combination.

In an alternative embodiment, the dispensing nozzle unit may feature a second central passageway for accommodating the second collecting chamber and the second directional channel. As such, the dispensing nozzle unit receives the first and the second beverage fluids from the respective lines via the central inlet passageway and the second central inlet passageway, whereby these fluids are directed to the base portion for combination.

The dispensing nozzle unit further includes at least one core inlet passageway each extending through the dispensing nozzle unit and designated for receiving the third beverage fluid from the third beverage fluid line. Operatively, if for example the first beverage fluid is carbonated water, the second beverage fluid is plain water, and the third beverage fluid is cola flavored beverage flavored syrup, a "watered-down" cola is formed by carrying carbonated and plain water as well as beverage flavored syrup through the central inlet and core inlet passageways, respectively, and by combination thereof at the base portion.

The nozzle assembly includes a multi-port fitting device linked with the first beverage fluid line, the second beverage fluid line, and the dispensing nozzle unit for directing the first and second beverage fluids from the first and second beverage fluid lines to the preferred central inlet passageway. The multi-port fitting device includes a first fluid pathway in communication with the first beverage fluid line for channeling the first beverage fluid to the first collecting chamber. A second fluid pathway in communication with the second beverage fluid line is provided for channeling the second beverage fluid to the second collecting chamber. The multi-port fitting device includes a flow washer preferably disposed with the second fluid pathway for facilitating flow control over a wide range of pressures.

The nozzle assembly includes a swivel fitting device linked with a beverage fluid line, such as the first beverage fluid line, for carrying beverage fluid therein. The swivel fitting device includes a first body segment and a second body segment coupled with the first body segment in that each body segment swivels relative to one another, thereby enabling the nozzle dispensing assembly to connect with a beverage fluid line about a wide range of spatial angles. Specifically, the swivel fitting device includes a swivel inlet passageway formed by the first body segment and a swivel outlet passageway formed by the second body segment in communication with the swivel inlet passageway, whereby beverage fluid flows through the swivel fitting device from the swivel inlet passageway to the swivel outlet passageway. A flow washer may be provided between the first and the second body segments for facilitating flow control over a wide range of pressures.

In accordance with the present invention, a method for passing a first, a second, and a third beverage fluid through a nozzle assembly, includes linking a first, a second, and a third beverage fluid line with the dispensing nozzle unit. The dispensing nozzle unit thus receives and combines the first, the second, and the third beverage fluids to provide a desired drink.

It is therefore an object of the present invention to provide a beverage dispenser nozzle assembly and an associated method for increasing availability of drink flavors dispensed therefrom.

It is a further object of the present invention to provide a single dispensing nozzle unit from the nozzle assembly that can accommodate a large number of beverage fluid lines to enhance the availability of drink flavors dispensed therefrom.

It is still a further object of the present invention to provide a multi-port fitting device and a swivel fitting device for facilitating coupling of a dispensing nozzle unit with a large number of beverage fluid lines.

Still other objects, features, and advantages of the present invention will become evident to those skilled in the art in light of the following.

BRIEF DESCRIPTION OF THE DRAWINGS

FIG. 2 illustrates a dispensing nozzle unit from a nozzle assembly according to the preferred embodiment for forming a desired beverage therein.

FIG. 3 illustrates an alternative embodiment of the dispensing nozzle of FIG. 2 featuring a first central inlet passageway and a second central inlet passageway each for receiving respective beverage fluids from external sources.

FIG. 4 illustrates a multi-port fitting device coupled with a dispensing nozzle unit.

FIG. 5 illustrates a multi-port fitting device according to the preferred embodiment.

FIG. 6 illustrates a swivel fitting device from a nozzle assembly according to the preferred embodiment for linking a beverage fluid source with a dispensing nozzle unit along any spatial direction.

DETAILED DESCRIPTION OF THE PREFERRED EMBODIMENT

As required, detailed embodiments of the present invention are disclosed herein, however, it is to be understood that the disclosed embodiments are merely exemplary of the invention, which may be embodied in various forms; the figures are not necessarily to scale; and some features may be exaggerated to show details of particular components or steps.

Figure 1:
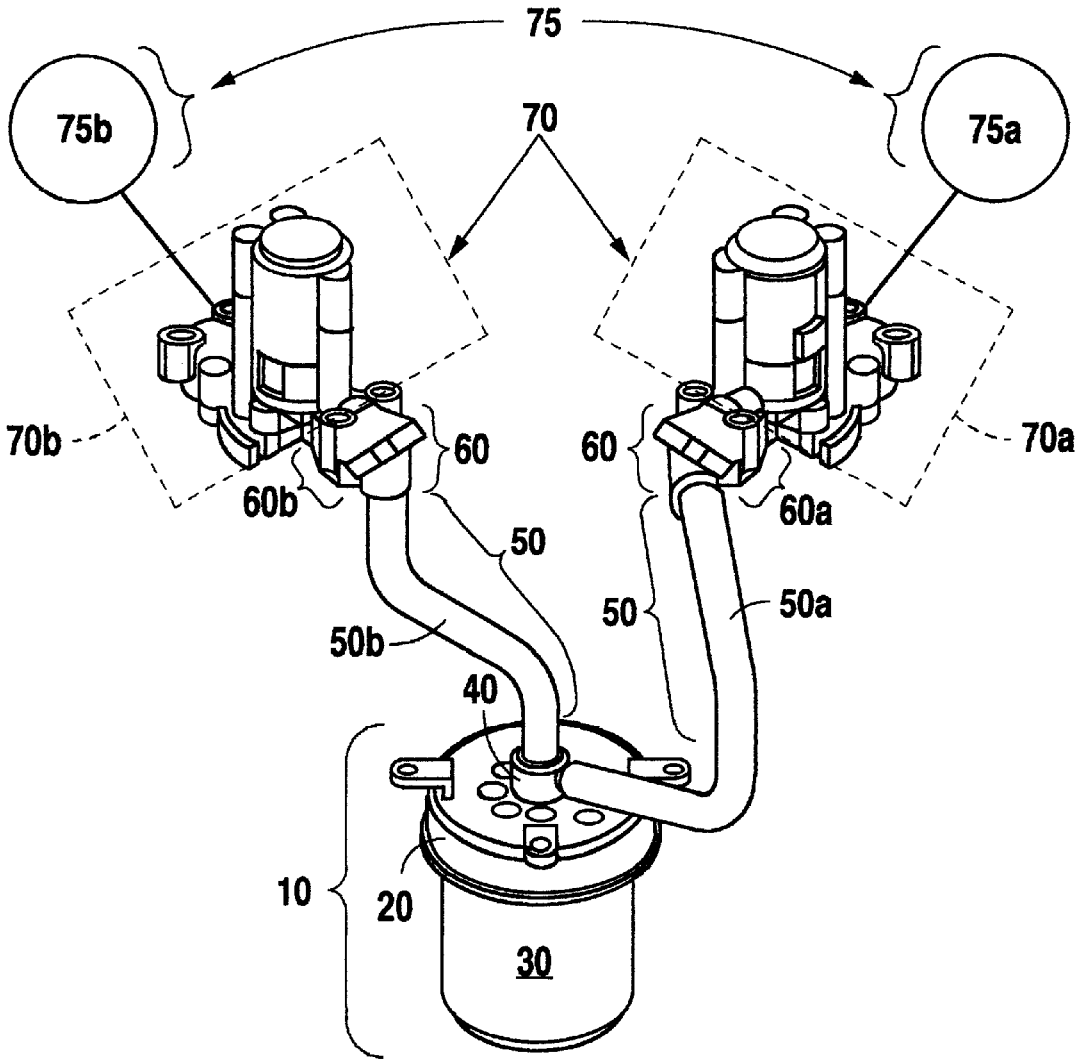
FIG. 1 is a schematic view illustrating a nozzle assembly for a beverage dispenser according to the preferred embodiment.
Figure 2A:
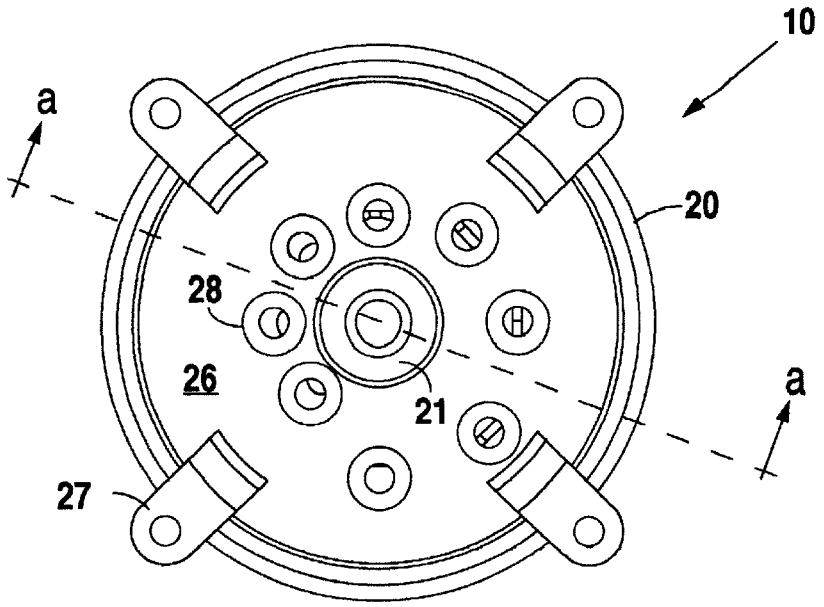
FIG. 2*a*, is a top view of the dispensing nozzle unit where beverage fluid for forming a desired beverage is received.
Figure 2B:
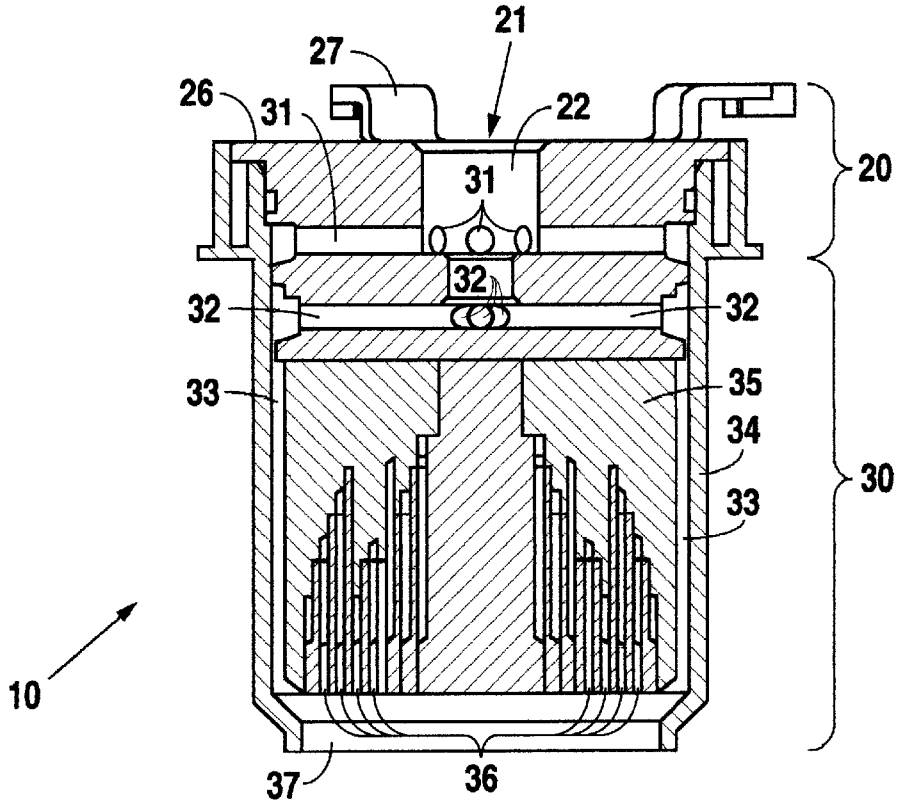
FIG. 2*b*, is a cross-section taken along the line a—a of FIG. 2*a* depicting the dispensing nozzle unit.
Figure 3A:
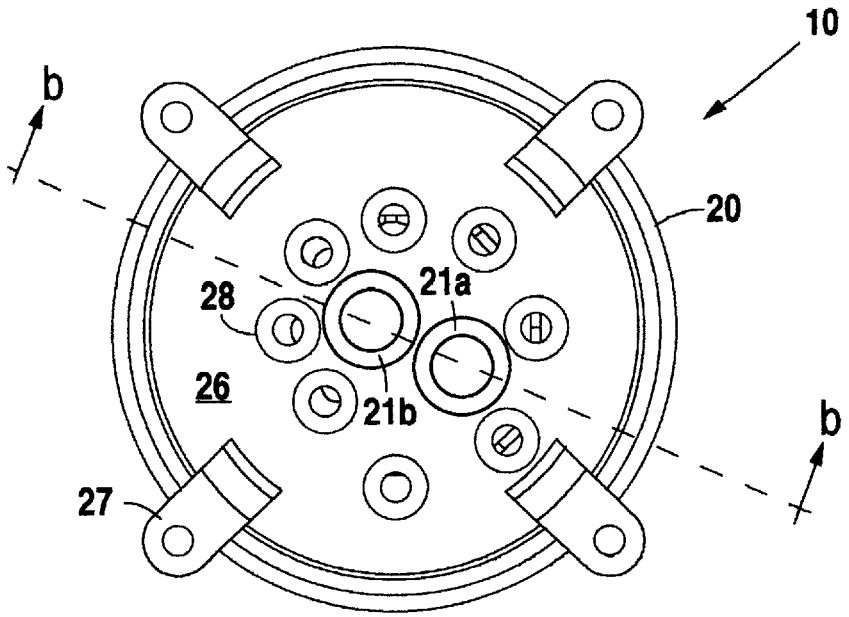
FIG. 3*a*, is a top view of the dispensing nozzle unit.
Figure 3B:
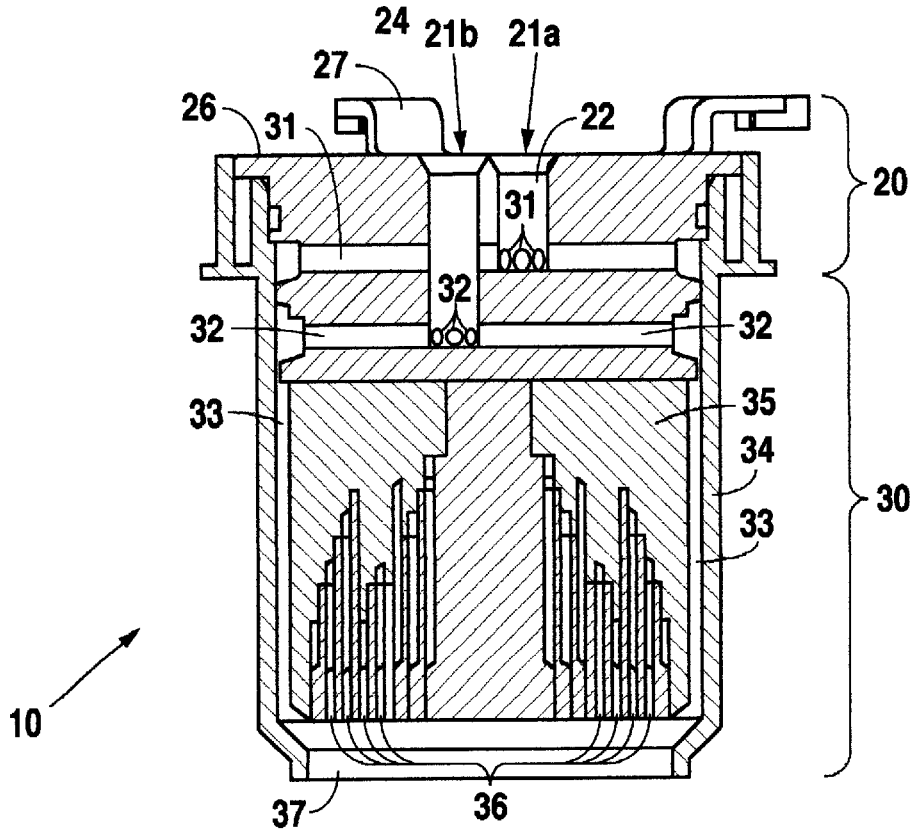
FIG. 3*b*, is a cross-section taken along the line b—b of FIG. 3*a* depicting the dispensing nozzle unit.

As illustrated in FIGS. 1–3, a nozzle assembly 1 includes a dispensing nozzle unit 10 and a multi-port fitting device 40 coupled with the dispensing nozzle unit 10. Nozzle assembly 1 dispenses a beverage flavored syrup mixed with a diluent source such as either plain water or carbonated water. Beverage fluids, such as beverage flavored syrup and plain or carbonated water, are combined by the dispensing nozzle unit 10 to thus form a desired drink. As generally referenced in FIG. 1, beverage fluids are each drawn from a respective beverage fluid source 75 by a pumping assembly 70. Moreover, each beverage fluid is carried by a separate beverage fluid line 50 from a respective beverage fluid source 75 to a dispensing nozzle unit 10.

As described in detail below, the multi-port fitting device 40 communicates a beverage fluid line 50 with the dispensing nozzle unit 10, thereby allowing for beverage fluids to enter the dispensing nozzle unit 10. In the preferred embodiment, a swivel fitting device 60 is provided for linking each beverage fluid line 50 ultimately to a respective beverage fluid source 75 along any spatial direction.

In operation, beverage fluids are pumped by the pumping assembly 70 across each beverage fluid line 50. Beverage fluid from the beverage fluid line 50 is received by the dispensing nozzle unit 10 via the multi-port fitting device 40. Beverage fluids are then combined within the dispensing nozzle unit 10 to form and dispense a desired beverage therefrom.

Although those skilled in the art will recognize that the nozzle assembly 1 can be equipped with other nozzles suitable for dispensing a desired drink, the preferred dispensing nozzle unit 10 comprises a multiple flavor beverage dispensing air-mix nozzle as disclosed in U.S. Pat. Nos. 6,047,859 and 6,098,842, the disclosures of which are incorporated herein by reference. Specifically, as illustrated in FIG. 2, the dispensing nozzle unit 10 includes an upper portion 20 and a base portion 30 coupled with the upper portion 20 so that, in the preferred embodiment, the upper portion 20 and the base portion 30 form a single piece.

The base portion 30 includes an outer wall 34 disposed about the dispensing nozzle unit 10, a nozzle core 35 positioned substantially within the outer wall 34, and an outlet nozzle 37 formed by the outer wall 34 and the nozzle core 35. Moreover, an annular passageway 33, defined by the outer wall 34 and the nozzle core 35 therebetween, is provided for channeling beverage fluid across the base portion 30 to the outlet nozzle 37. In the preferred embodiment, nozzle core 35 defines an array of passageways 36 for delivering beverage fluid, such as beverage flavored syrup, to the outlet nozzle 37.

The upper portion 20 provides a top surface 26. Although those skilled in the art will recognize other suitable securing means, mounting brackets 27 in this preferred embodiment are fixed to the top surface 26 to secure dispensing nozzle unit 10 to a beverage dispenser (not shown).

The upper portion 20 includes a central inlet passageway 21 for receiving beverage fluids from the beverage fluid line 50. As shown in FIG. 2, the preferred central inlet passageway 21 features a first collecting chamber 22 extending from the top surface 26 into the dispensing nozzle unit 10 for directing a first beverage fluid to the annular passageway 33. Although the preferred central inlet passageway 21 is positioned substantially centrally along the dispensing nozzle unit 10, those of ordinary skill in the art will recognize other suitable locations along the dispensing nozzle unit 10 for a central inlet passageway. In particular, first directional channels 31, linked with the first collecting chamber 22 and with the annular passageway 33, are provided to carry the first beverage fluid from the first collecting chamber 22 to the annular passageway 33. Although those ordinary skill in the art may contemplate a using a single channel, in the preferred embodiment, the first directional channels 31 include a plurality of channels extending radially outwardly from the first collecting chamber 22 to the annular passageway 33. The first beverage fluid thus flows from the first directional channels 31 to the annular passageway 33, which is in communication with the first directional channels 31.

Similarly, the preferred central inlet passageway 21 features a second collecting chamber 24 in communication with and extending from the first collection chamber 22 into the dispensing nozzle unit 10 for directing a second beverage fluid to the annular passageway 33. In particular, second directional channels 32, linked with the second collecting chamber 24 and with the annular passageway 33, are provided to carry the second beverage fluid from the second collecting chamber 24 to the annular passageway 33. Although those of ordinary skill in the art may contemplate using a single channel, in the preferred embodiment, the second directional channels 31 include a plurality of channels extending radially outwardly from the second collecting chamber 24 to the annular passageway 33. The second beverage fluid thus flows from the second directional channels 32 to the annular passageway 33 in communication with the second directional channels 31. Accordingly, the second beverage fluid and the first beverage fluid flow across the annular passageway 33 to the outlet nozzle 37.

The preferred central inlet passageway 21 features a first and a second collecting chamber as well as a first and a second directional channels for delivering respective first and second beverage fluids to the annular passageway 33. Nevertheless, those of ordinary skill in the art will recognize that a central inlet passageway may comprise any number of collecting chambers and directional channels to accommodate delivery of respective beverage fluids to the annular passageway 33. As such, for the embodiment of FIG. 3, the upper portion 20 includes a first central inlet passageway 21*a* linked with the first collecting chamber 22 for receiving the first beverage fluid and a second central inlet passageway 21*b* linked with the second collecting chamber for receiving the second beverage fluid.

In the preferred embodiment, plain and carbonated water comprise beverage fluids delivered to the central inlet passageway 21, as discussed in greater detail below. Thus, for example, if carbonated water comprises the first beverage fluid and plain water comprises the second beverage fluid, carbonated water will flow through the first collecting chamber 22 and first directional channels 31 without interfering with the flow of plain water through the second collecting chamber 24 and the second directional channels 32.

Figure 4A:
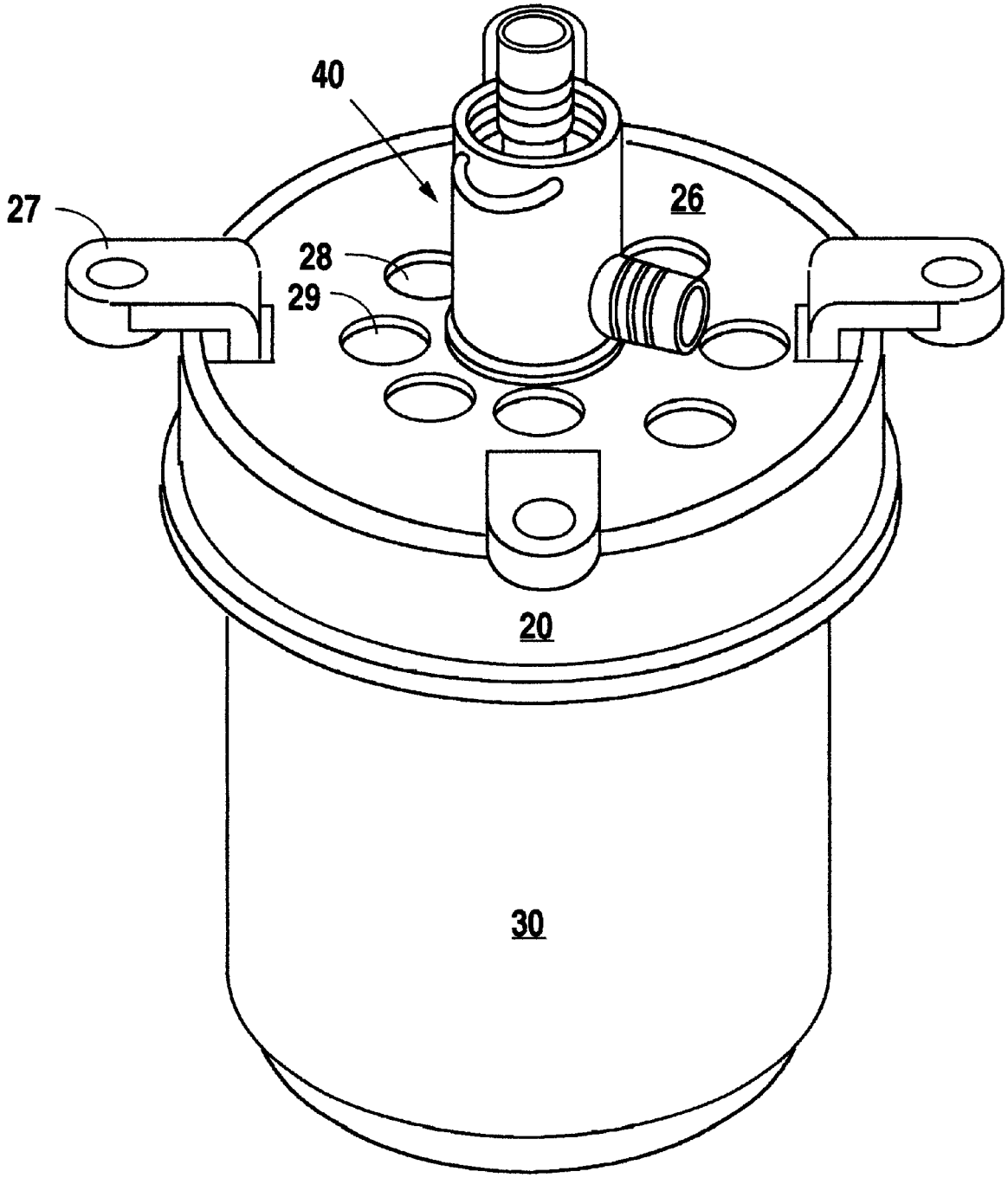
FIG. 4*a* is a perspective view illustrating a multi-port fitting device coupled with a dispensing nozzle unit.
Figure 4B:
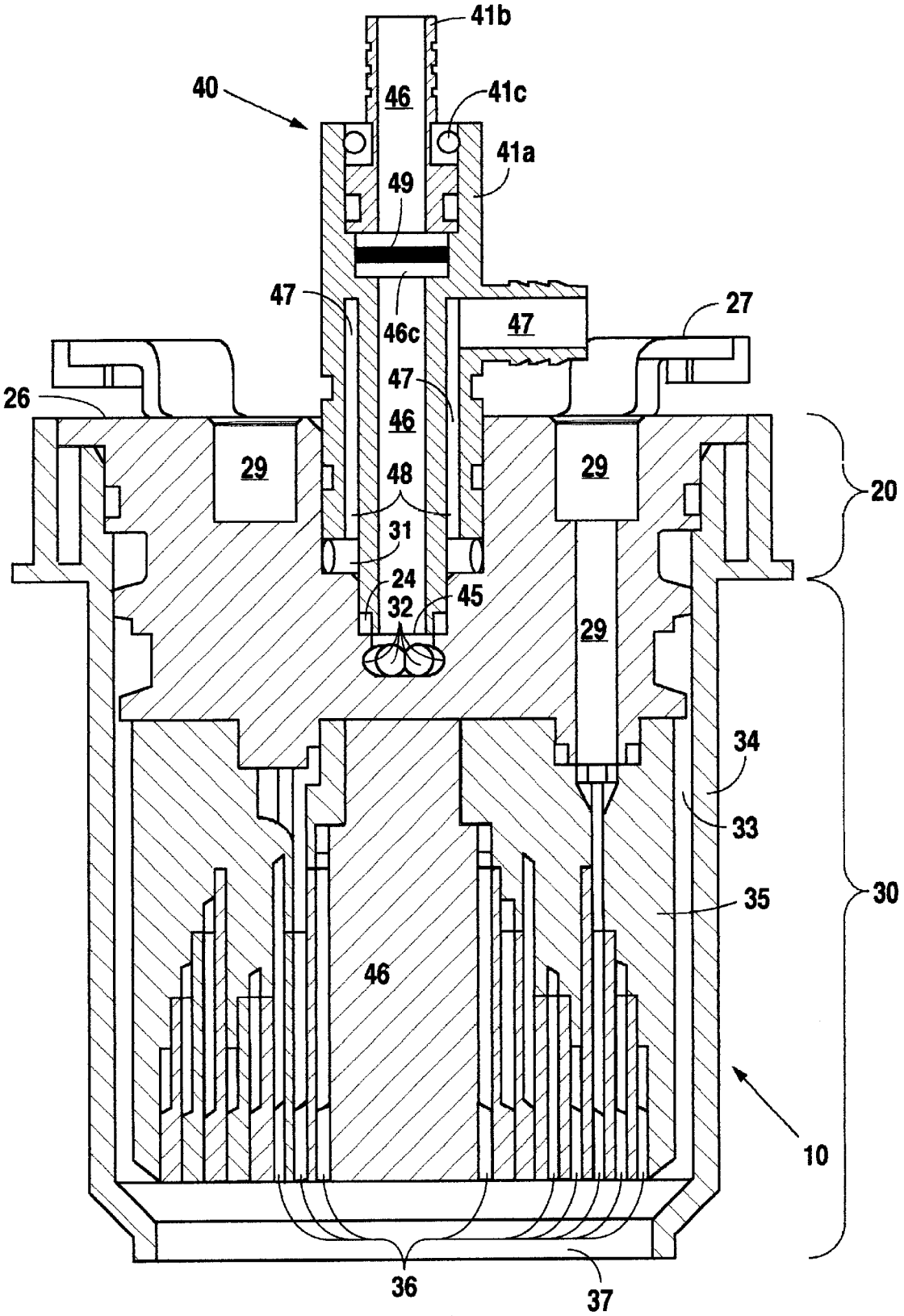
FIG. 4*b* is a cross-sectional view illustrating the coupling.

In a similar manner, as shown in FIG. 4, the upper portion 20 includes at least one core inlet passageway 29 each designated for receiving a particular beverage fluid delivered from a beverage fluid source. The preferred core inlet passageway 29 features an entry orifice 28 formed by the top surface 26 for receiving beverage fluids. In this preferred embodiment, the preferred beverage fluids comprise various beverage flavored syrups, such as cola or punch flavoring, whereby each beverage flavored syrup is delivered to a designated core inlet passageway as discussed in greater detail below. Inasmuch, the core inlet passageway 29 extends from the entry orifice 28 to the base portion 30 of the dispensing nozzle unit 10. Each core inlet passageway 29 is thus linked with a respective passageway from the array of passageways 36 so that beverage fluid flows from the core inlet passageway 29 across the passageway from the array of passageways 36 to the outlet nozzle 37. At the outlet nozzle 37, beverage fluid from the array of passageways 36 is combined with beverage fluid from the annular passageway 33 to thus form a desired beverage.

Illustratively, if cola is desired, carbonated water is carried from the first collecting chamber 22, through the first directional channels 31 and the annular passageway 33 to the outlet nozzle 37. Similarly, cola flavored beverage flavored syrup is carried from the core inlet passageway 29 designated for cola flavoring, through the corresponding passageway from the array of passageways 36 to the outlet nozzle 37. At the outlet nozzle 37, carbonated water is combined with cola flavored beverage flavored syrup to form cola.

Furthermore, if a lightly carbonated or "watered down" cola is desired for example, plain and carbonated water are brought from their respective sources to the central inlet passageway 21. Carbonated water is carried from the first collecting chamber 22, through the first directional channels 31 and the annular passageway 33 to the outlet nozzle 37. In a similar manner, plain water is carried from the second collecting chamber 24, through the second directional channels 32 and the annular passageway 33 to the outlet nozzle 37. Additionally, cola flavored beverage flavored syrup is carried from the core inlet passageway 29 designated for cola flavoring, through the corresponding passageway from the array of passageways 36 to the outlet nozzle 37. At the outlet nozzle 37, plain water is combined with carbonated water and cola flavored beverage flavored syrup to form a watered-down cola.

Figure 5B:
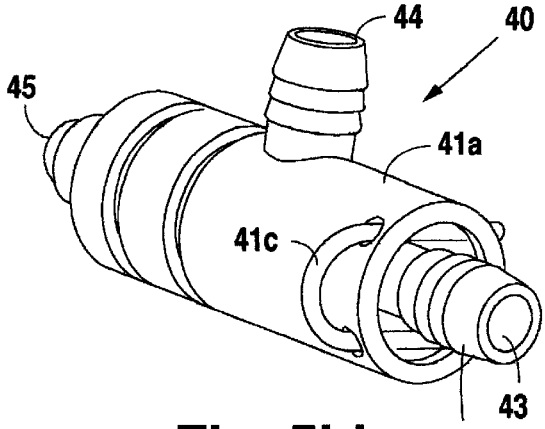
FIG. 5*bb*, is a perspective view of the multi-port fitting device featuring, as preferred, the cap piece secured to the main body via a bracket.
Figure 5A:
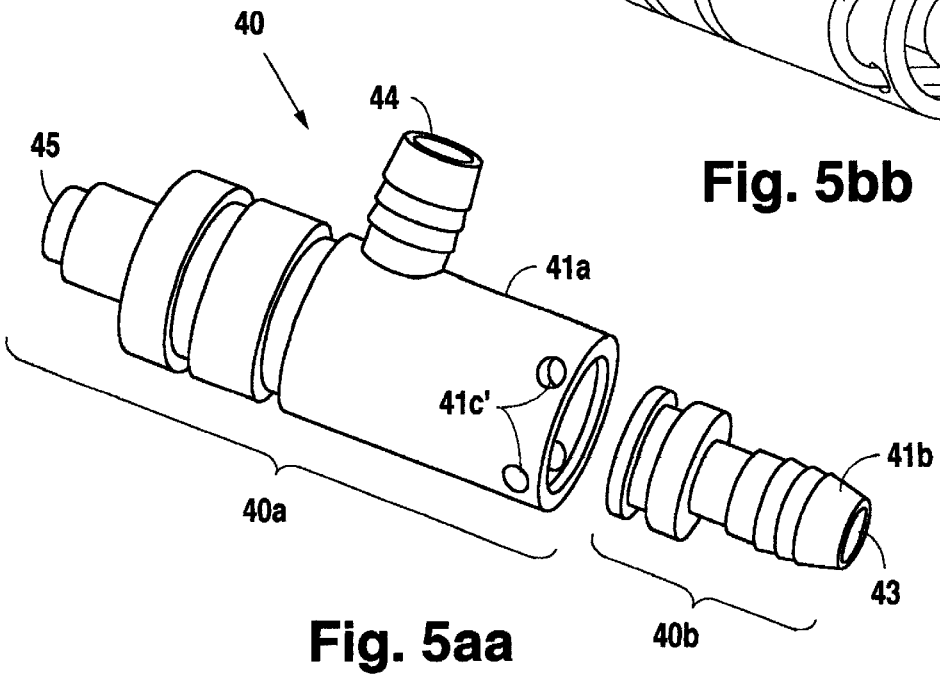
FIG. 5*aa* is an exploded view of the multi-port fitting device featuring a central piece and a cap piece for insertion into the central piece.

The preferred multi-port fitting device 40, as shown in FIG. 5, is engagedly linked with the central inlet passageway 21 to allow first and second beverage fluids to enter the dispensing nozzle unit 10. In the preferred embodiment, the multi-port fitting device 40 includes a central piece 40*a* and a cap piece 40*b* for insertion into the central piece 40*a*. It should be added that although the preferred multi-port fitting device 40 includes the central piece 40*a* and the cap piece 40*b*, those of ordinary skill in the art will readily recognize that the multi-port fitting device 40 can be formed of a single piece. Thus, while in a use, a cap piece body 41*b* is secured within a central piece body 41*a* via a bracket 41*c*. In FIGS. 5*aa* and 5*bb*, the bracket 41*c* is inserted through guide holes 41*c*' of central piece body 41*a* to secure the cap piece body 41*b* within the central piece body 41*a*. Other embodiments contemplate the cap piece 40*b* as sufficiently fitting and securing to the central piece 40*b* without the need for a bracket or other suitable means deemed by those of ordinary skill in the art.

Figure 5C:
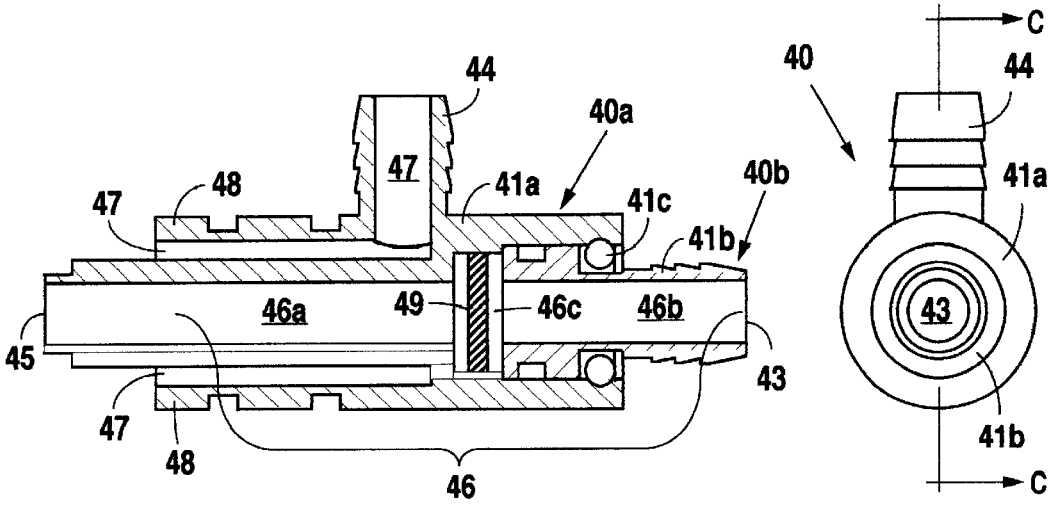
FIG. 5*cc* illustrates the multi-port fitting device in cross-section along the line c—c.

As shown in FIG. 5*cc*, the preferred multi-port fitting device 40 includes a first fluid pathway 47 defined by the central piece 40*a* to accommodate flow of first beverage fluid from a first beverage fluid line 50*a*, see FIG. 1, to the central inlet passageway 21. Similarly, the multi-port fitting device 40 includes a second fluid pathway 46 defined by the central piece 40*a* and the cap piece 40*b* to accommodate the flow of second beverage fluids from a second beverage fluid line 50*b* to the central inlet passageway 21. In particular, as shown in FIG. 5*cc*, the second fluid passageway 46 includes a central piece second fluid passageway 46*a* formed by the central piece body 41*a* and a cap piece second fluid passageway 46*b*, for receiving the second beverage fluid from the second beverage fluid line 50*b*, formed by the cap piece body 41*d* and in communication with the central piece second fluid passageway 46*a*.

The central piece body 41*a* provides a first multi-port outlet 48 and a first multi-port inlet 44 extending from the multi-port body 41. The first multi-port inlet 44 is coupled with the first beverage fluid line 50*a*, thereby allowing the first beverage fluid to flow from the first beverage fluid line 50*a* into the multi-port fitting device 40. As in FIG. 4*b*, the first multi-port outlet 48 is linked with the first collecting chamber 22 of the central inlet passageway 21, whereby the first beverage fluid flows from the multi-port fitting device 40 into the dispensing nozzle unit 10 via the first fluid pathway 47. Similarly, while the cap piece body 41*b* is placed within a central piece body 41*a*, the multi-port fitting device further includes a second multi-port inlet 43 defined by the cap piece body 41*b* and a second multi-port outlet 45 defined by the central piece body 41*a*. The second multi-port inlet 43 is coupled with a second beverage fluid line 50*b*, see FIG. 1, thereby allowing the second beverage fluid to flow from the second beverage fluid line 50*b* into the multi-port fitting device 40. The second multi-port outlet 45 is linked with the second collecting chamber 24 of the central inlet passageway 21, whereby the second beverage fluid flows from the multi-port fitting device 40 into the dispensing nozzle unit 10 via the second fluid pathway 46. Accordingly, despite space constraints imposed by the dispensing nozzle unit 10, the multi-port fitting device 40 facilitates a greater number of beverage fluid lines than other fitting devices, thereby enhancing the availability of drink flavors dispensed from the dispensing nozzle unit 10.

It should be added that those of ordinary skill in the art will recognize that the multi-port fitting device 40 may include any number of fluid pathways to accommodate the central inlet passageway 21. Moreover, although FIG. 5 shows the first fluid pathway 47 concentrically disposed about the second fluid pathway 46, other embodiments contemplate pathways 46, 47 as positioned in parallel with one another within the multi-port fitting device 40 to provide respective beverage fluids to the central inlet passageway 21.

In the preferred embodiment, a multi-port flow washer 49 is provided within the second fluid passageway 46, between the central piece second fluid passageway 46*a* and the cap piece second fluid passageway 46*b*. Those of ordinary skill in the art, however, should recognize that a multi-port flow washer may be inserted into the first fluid passageway 47 or that a plurality of washers may be inserted within a plurality of passageways provided within the multi-port fitting device 40. While in use, the multi-port flow washer 49 is disposed within a flow washer containment chamber 46*c*, defined by the cap piece body 41*b* and the central piece body 41*a*, and is held in place therein by abutment with the cap piece 40*b*. The multi-port flow washer 49 is a flow washer widely known in the industry. Inasmuch, the multi-port flow washer 49 provides flow control of beverage fluid over a wide range of fluid pressures in that the multi-port flow washer 49 features a valving orifice that contracts and expands with increasing and decreasing fluid pressure, respectively.

In FIG. 1, the preferred swivel fitting device 60 is engagedly linked at one end with the beverage fluid line 50 and at another end with the pumping assembly 70, thus ultimately linking each beverage fluid line 50 to a respective beverage fluid source 75.

While connected with the pumping assembly 70, the swivel fitting device 60 provides a multi-angle connection to the beverage fluid line 50.

Figure 6A:
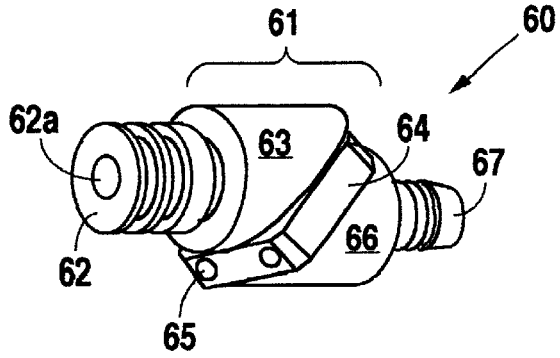
FIG. 6*a* is a perspective view along the first body segment (left) of the swivel fitting device.
Figure 6B:
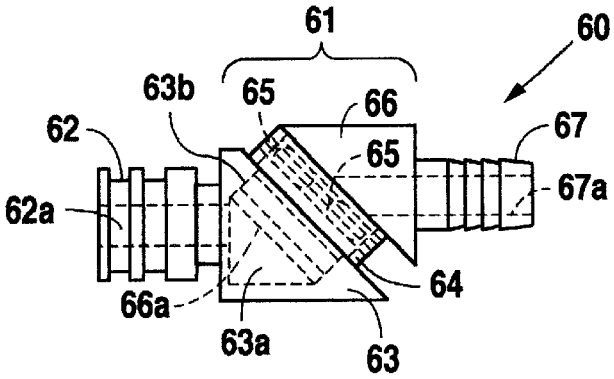
FIG. 6*b* is a cross-sectional view illustrating a swivel fitting device featuring a flow washer for regulating fluid flow through the swivel fitting device.

In particular, in FIG. 6, the swivel fitting device 60 includes a swivel body 61 having a first body segment 63 and a second body segment 66. In the preferred embodiment, the first body segment 63 forms a holding chamber 63*a* having an exposed opening 63*b* for ultimately receiving the second body segment 66. As such, the exposed opening 63*b* defines a recess for engagedly receiving a mating element 66*a* protruding from the second body segment 66.

Figure 6C:
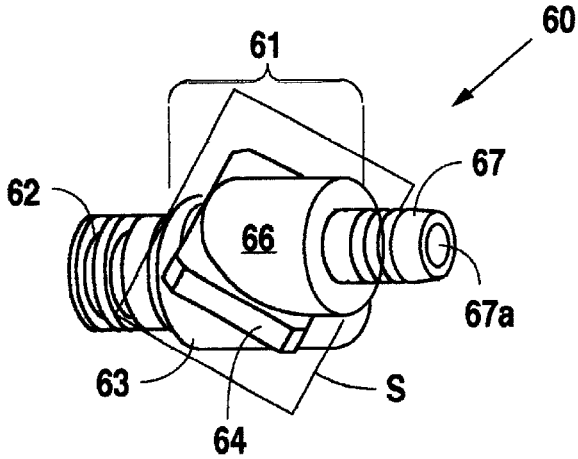
FIG. 6*c* is a perspective view along the second body segment (right) of the swivel fitting device.

As shown in FIG. 6*c*, the mating element 66*a* therefore enables the second body segment 66 to be rotated at an angle from 0° to 360° along plane S, hereinafter defined as the term "swivel", about the first body segment 63, thereby allowing for a beverage fluid line to connect with a pumping assembly at any spatial direction. This swivel feature is especially advantageous when a dispensing nozzle is configured to accommodate a large number of beverage fluid lines, such as a multiple flavor beverage dispensing air-mix nozzle, where there is limited space about the dispensing nozzle. Unlike a swivel fitting device, current fittings can only provide 45°, 90°, and 180° connections, thereby further limiting the space about a dispensing nozzle.

The swivel fitting device 60 includes a swivel fitting device inlet 62 extending from the first body segment 63 and a swivel fitting device outlet 67 extending from the second body segment 66. The swivel fitting device inlet 62 defines a swivel inlet passageway 62*a*, in communication with the holding chamber 63*a*, for receiving beverage fluid from the pumping assembly 70. The second body segment 66 defines a swivel outlet passageway 67*a*, in communication with the holding chamber 63*a* via the mating element 66*a*, for delivering beverage fluid from the swivel fitting device outlet 67 to the beverage fluid line 50.

Furthermore, in the preferred embodiment, a locking washer 64 is provided along plane S between the first and second body segments 63, 66 to secure the coupling of and to guard against wear between the first and second body segments 63, 66. The locking washer 64 may include a flow washer 65 secured therein and in engagement with the swivel outlet passageway 67*a* and the holding chamber 63*a* The flow washer 65 is a flow washer widely known in the industry. Inasmuch, the flow washer 65 provides flow control of beverage fluid over a wide range of fluid pressures in that the flow washer 65 features a valving orifice that contracts and expands with increasing and decreasing fluid pressure, respectively. The flow washer 65 is especially advantageous for instances where the pumping assembly 70 comprises a volumetric dispensing valve such as that described in U.S. Pat. No. 5,381,926, entitled "Beverage Dispensing Valve and Method" and assigned to The Coca-Cola Company, whereby volumetric dispensing valves typically do not feature flow washers.

In operation, the swivel fitting device outlet 67 is engagedly linked with the beverage fluid line 50 for receiving beverage fluid therefrom. In a similar manner, the swivel fitting device inlet 62 is engagedly linked with the pumping assembly 70 to deliver beverage fluid thereto. As such, beverage fluid flows from the swivel inlet passageway 62*a* across the holding chamber 63*a* to the swivel outlet passageway 67*a*. In addition, beverage fluid may flow through the valving orifice of flow washer 65 as it travels from the holding chamber 63*a* to the swivel outlet passageway 67*a*.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description, rather, it is defined only by the claims that follow.

We claim:

1. A nozzle assembly, comprising:

a first beverage fluid line for carrying a first beverage fluid therein;

a second beverage fluid line for carrying a second beverage fluid therein;

a third beverage fluid line for carrying a third beverage fluid therein;

a dispensing nozzle unit, comprising:

a base portion, an upper portion, and a central inlet passageway in the upper portion, the central inlet passageway including a first collecting chamber communicating with the base portion and a second collecting chamber communicating with the base portion; and a multi-port fitting device linked with the first beverage fluid line and the second beverage fluid line, the multi-port fitting device disposed in the central inlet passageway of the dispensing nozzle unit for directing the first beverage fluid from the first beverage fluid line to the first collecting chamber and the second beverage fluid from the second beverage fluid line to the second collecting chamber, whereby the dispensing nozzle unit receives and combines the third beverage fluid and one of the first and the second beverage fluids to produce a desired drink dispensed therefrom.

2. The nozzle assembly according to claim 1, wherein the nozzle dispensing assembly receives and combines the third beverage fluid and both the first and the second beverage fluids to produce a desired drink therefrom.

3. The nozzle assembly according to claim 1, further comprising:

a fourth beverage fluid line for carrying a fourth beverage fluid therein, whereby the dispensing nozzle unit is linked with the fourth beverage fluid line for receiving and combining the fourth beverage fluid and one of the first and the second beverage fluids to produce a desired drink dispensed therefrom.

4. The nozzle assembly according to claim 3, wherein the nozzle dispensing assembly receives and combines the fourth beverage fluid and both the first and the second beverage fluids to produce a desired drink therefrom.

5. The nozzle assembly according to claim 1 wherein the central inlet passageway further includes a first directional channel linked with the first collecting chamber for directing the first beverage fluid from the first collecting chamber to the base portion.

6. The nozzle assembly according to claim 1 wherein the second central inlet passageway includes a second directional channel linked with the second collecting chamber for directing the second beverage fluid from the second collecting chamber to the base portion.

7. The nozzle assembly according to claim 1 wherein the multi-port fitting device includes:

a first fluid pathway in communication with the first beverage fluid line for channeling the first beverage fluid to the first collecting chamber; and a second fluid pathway for in communication with the second beverage fluid line for channeling the second beverage fluid to the second collecting chamber.

8. The nozzle assembly according to claim 7, wherein the multi-port fitting device further includes:

a flow washer disposed within the second fluid pathway for providing flow control over a wide range of pressures.

9. A nozzle assembly, comprising:

a first beverage fluid line for carrying a first beverage fluid therein;

a second beverage fluid line for carrying a second beverage fluid therein;

a third beverage fluid line for carrying a third beverage fluid therein;

a swivel fitting device linked with the first beverage fluid line for carrying the first beverage fluid therein; and a dispensing nozzle unit linked with the first, the second, and the third beverage fluid lines for receiving and combining the third beverage fluid and one of the first and the second beverage fluids to produce a desired drink dispensed therefrom.

10. The nozzle assembly according to claim 9 wherein the swivel fitting device comprises:

a first body segment and a second body segment coupled with the first body segment, whereby each body segment swivels relative to one another.

11. The nozzle assembly according to claim 10 wherein the swivel fitting device further comprises:

a swivel inlet passageway formed by the first body segment; and a swivel outlet passageway formed by the second body segment in communication with the swivel inlet passageway;

whereby the first beverage fluid flows through the swivel fitting device from the swivel inlet passageway to the swivel outlet passageway.

12. nozzle assembly according to claim 11, wherein the swivel fitting device further comprises:

a flow washer disposed between the first and the second body segments and in engagement with the swivel inlet and the swivel outlet passageways for providing flow control over a wide range of fluid pressures.

13. The nozzle assembly according to claim 9, wherein the nozzle dispensing assembly receives and combines the third beverage fluid and both the first and the second beverage fluids to produce a desired drink therefrom.

14. A method for passing a first, a second, and a third beverage fluid through a nozzle assembly, comprising the steps of:

linking a first beverage fluid line for carrying the first beverage fluid therein with a multi-port fitting device;

linking a second beverage fluid line for carrying a second beverage fluid therein with the multi-port fitting device;

linking a third beverage fluid line for carrying a third beverage fluid therein with a dispensing nozzle unit, the dispensing nozzle unit, comprising:

a base portion, an upper portion, and a central inlet passageway in the upper portion, the central inlet passageway including a first collecting chamber communicating with the base portion and a second collecting chamber communicating with the base portion;

inserting the multi-port fitting device into the central inlet passageway of the dispensing nozzle unit;

directing the first beverage fluid from the first beverage fluid line to the first collecting chamber of the dispensing nozzle unit via the multi-port fitting device;

directing the second beverage fluid from the second beverage fluid line to the second collecting chamber of the dispensing nozzle unit via the multi-port fitting device;

receiving and combining via the dispensing nozzle unit the third beverage fluid and one of the first and the second beverage fluids to provide a desired drink therefrom.

15. The method according to claim 14 further comprising the step of:

linking a fourth beverage fluid line for carrying a fourth beverage fluid therein with the dispensing nozzle unit.

16. The method according to claim 15 further comprising the step of:

receiving and combining via the dispensing nozzle unit the fourth beverage fluid and one of the first and the second beverage fluids to produce a desired drink dispensed therefrom.

17. The method according to claim 14 wherein the central inlet passageway includes a first directional channel linked with the first collecting chamber and a second directional channel linked with the second collecting chamber.

18. The method according to claim 17, further comprising the steps of:

directing the first beverage fluid from the first collecting chamber to the base portion; and directing the second beverage fluid from the second collecting chamber to the base portion.

19. The method according to claim 14, wherein the multi-port fitting device includes:

a first fluid pathway in communication with the first beverage fluid line for channeling the first beverage fluid to the first collecting chamber from the dispensing nozzle unit; and a second fluid pathway in communication with the second beverage fluid line for channeling the second beverage fluid to the second collecting chamber from the dispensing nozzle unit.

20. The method according to claim 19, further comprising the steps of:

channeling the first beverage fluid to the first collecting chamber from the dispensing nozzle unit; and channeling the second beverage fluid to the second collecting chamber from the dispensing nozzle unit.

21. The method according to claim 20 wherein the step of channeling the second beverage fluid, comprises:

disposing a fluid washer within the second fluid passageway; and controlling flow of the second beverage fluid over a wide range of pressures via the flow washer.

22. A method for passing a first, a second, and a third beverage fluid through a nozzle assembly, comprising the step of:

linking a first beverage fluid line for carrying the first beverage fluid therein with a dispensing nozzle unit;

linking a second beverage fluid line for carrying a second beverage fluid therein with the dispensing nozzle unit;

linking a third beverage fluid line for carrying a third beverage fluid therein with the dispensing nozzle unit;

linking a swivel fitting device with the first beverage fluid line for carrying the first beverage fluid therein; and receiving and combining via the dispensing nozzle unit the third beverage fluid and one of the first and the second beverage fluids to provide a desired drink therefrom.

23. The method according to claim 22 wherein the swivel fitting device comprises:

a first body segment and a second body segment coupled with the first body segment whereby each body segment swivels relative to one another;

a swivel inlet passageway formed by the first body segment; and a swivel outlet passageway formed by the second body segment in communication with the swivel inlet passageway.

24. The method according to claim 23, further comprising the step of:

swiveling the first body segment and the second body segment relative to one another.

25. The method according to claim 23, further comprising the step of:

passing the first beverage fluid through the swivel fitting device from the swivel inlet passageway to the swivel outlet passageway.

26. The method according to claim further comprising the step of:

controlling flow of the first beverage fluid across the swivel inlet and the swivel outlet passageways via a flow washer disposed between the first and the second body segments.

* * * * *